US005156726A

United States Patent [19]

Nakada et al.

[11] Patent Number: 5,156,726

[45] Date of Patent: Oct. 20, 1992

[54] OXYGEN-GENERATING ELECTRODE AND METHOD FOR THE PREPARATION THEREOF

[75] Inventors: Hiroyuki Nakada; Yukio Kawashima, both of Tokyo; Kazuhide Ohe, Kamagaya, all of Japan

[73] Assignee: TDK Corporation, Tokyo, Japan

[21] Appl. No.: 581,417

[22] Filed: Sep. 12, 1990

Related U.S. Application Data

[63] Continuation of Ser. No. 456,224, Dec. 20, 1989, abandoned, which is a continuation of Ser. No. 241,257, Sep. 7, 1988, abandoned.

[51] Int. Cl.[5] ..... C25B 11/08

[52] U.S. Cl. ..... 204/290 F

[58] Field of Search ..... 204/290 F, 291; 427/126.1, 126.3, 126.5, 419.2, 419.3, 427/226, 229

[56] References Cited

U.S. PATENT DOCUMENTS 4,331,528 5/1982 Beer et al. ..... 204/290 F

FOREIGN PATENT DOCUMENTS 56-123388 9/1981 Japan .
56-123389 9/1981 Japan .
54-116786 7/1982 Japan .
60-021232 5/1985 Japan .
60-184690 9/1985 Japan .
60-184691 9/1985 Japan .
1147442 4/1969 United Kingdom ..... 204/290 F

*Primary Examiner*—John Niebling
*Assistant Examiner*—Kathryn Gorgos
*Attorney, Agent, or Firm*—Wyatt, Gerber, Burke and Badie

[57] ABSTRACT

The electrode of the invention suitable for use in an oxygen-generating electrolytic process with durability comprises (A) a substrate of, e.g., titanium metal; (B) an undercoating layer thereon which is formed of a mixture of an iridium oxide and tantalum oxide in a limited molar proportion and (C) an overcoating layer formed of an iridium oxide. The undercoating layer can be formed by coating the substrate surface with a solution containing an iridium compound and tantalum compound each having thermal decomposability and then subjecting the coated substrate body to a heat treatment in an oxidizing atmosphere. Similarly, the overcoating layer can be formed by coating with a solution containing a thermally decomposable iridium compound followed by an oxidative heat treatment in an oxidizing atmosphere.

2 Claims, 1 Drawing Sheet

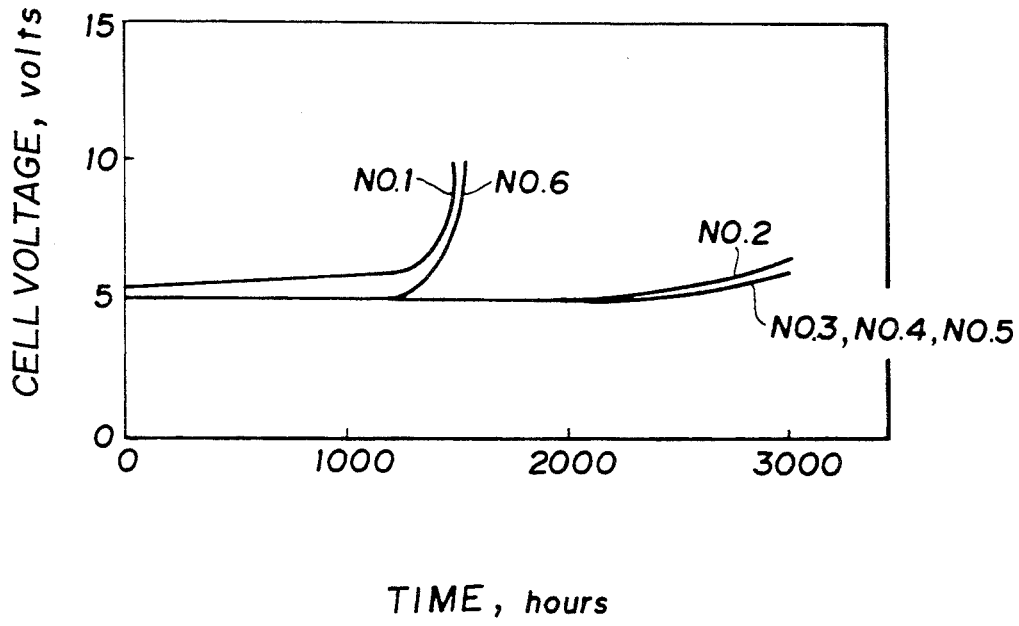
CELL VOLTAGE, volts
15
10
5
0
0
1000
2000
3000
TIME, hours
NO.1
NO.6
NO.2
NO.3, NO.4, NO.5

OXYGEN-GENERATING ELECTRODE AND METHOD FOR THE PREPARATION THEREOF

BACKGROUND OF THE INVENTION

The present invention relates to a novel oxygen-generating electrode and a method for the preparation thereof. More particularly, the invention relates to an electrode having excellent durability and low oxygen over-voltage for generating oxygen by electrolytically oxidizing an aqueous solution on an anode as well as a method for the preparation thereof.

A type of conventional metallic electrodes widely used in the electrolytic industry includes those prepared by providing a coating layer of a platinum group metal or an oxide thereof on an electroconductive substrate made of titanium metal.

For example, known electrodes used as the anode for producing chlorine by the electrolysis of brine include those prepared by providing a titanium substrate with a coating layer formed of an oxide mixture of ruthenium and titanium or an oxide mixture of ruthenium and tin (see, for example, Japanese patent publications 46-21884, 48-3954 and 50-11330).

Besides the above mentioned process of electrolysis of brine in which chlorine is produced as the electrolytic product, various processes are known in the electrolytic industry in which oxygen is generated on the electrode. Examples of such an oxygen-generating electrolytic processes include recovery of spent acids, alkalis or salts, electrolytic metallurgy of copper, zinc, etc., metal plating, cathodic protection and the like.

These oxygen-generating electrolytic processes require electrodes quite different from the electrodes successfully used in the electrolytic processes accompanied by generation of chlorine. When an electrode for the chlorine-generating electrolysis, such as the above mentioned titanium-based electrode having a coating layer of an oxide mixture of ruthenium and titanium or ruthenium and tin, is used in an oxygen-generating electrolytic process, the electrolysis must be discontinued before long due to rapid corrosion of the electrode. Namely, the electrodes must be specialized for the particular electrolytic processes. The electrodes most widely used in an oxygen-generating electrolysis are lead-based electrodes and soluble zinc anodes although other known and usable electrodes include iridium oxide and platinum-based electrodes, iridium oxide and tin oxide-based electrodes, platinum-plated titanium electrodes and the like.

These conventional electrodes are not always quite satisfactory due to the troubles which may be caused depending on the type of the oxygen-generating electrolytic process. When a soluble zinc anode is used in zinc plating, for example, the anode is consumed so rapidly that adjustment of the electrode distance must be performed frequently. When a lead-based insoluble electrode is used for the same purpose, a small amount of lead in the electrode is dissolved in the electrolyte solution to affect the quality of the plating layer. Platinum-plated titanium electrodes are also subject to rapid consumption when used in a process of a so-called high speed zinc plating process at a high current density of 100 $A/dm^2$ or higher.

Accordingly, it is an important technical problem in the technology of electrode manufacture to develop an electrode useful in an oxygen-generating electrolytic process which can be used with versatility in various processes without the above mentioned drawbacks.

When an oxygen generating electrolytic process is performed by using a titanium based electrode having a coating layer thereon, on the other hand, it is not rare or rather usual that an intermediate layer of titanium oxide is formed between the substrate surface and the coating layer to cause gradual increase in the anode potential or eventually to cause falling of the coating layer from the substrate surface which is in a passive state. Various attempts and proposals have been made to provide an appropriate intermediate layer beforehand between the substrate surface and the coating layer in order to prevent subsequent formation of a layer of titanium oxide (see, for example, Japanese Patent Publications 60-21232 and 60-22074 and Japanese patent Kokai 57-116786 and 60-184690).

The electrode having an intermediate layer provided as mentioned above is not so effective as desired when the electrode is used in an electrolytic process at a high current density because the electroconductivity of such an intermediate layer is usually lower than the overcoating layer.

It is also proposed to provide an intermediate layer formed by dispersing platinum in a matrix of a non-precious metal oxide (see Japanese patent Kokai 60-184691) or to provide an intermediate layer formed of an oxide of a valve metal, e.g., titanium, zirconium, tantalum and niobium, and a precious metal (see Japanese patent Kokai 57-73193). These electrodes are also not quite advantageous because platinum has no very high corrosion resistance in itself in the former type and, in the latter type, the kind of the valve metal oxide and the compounding amount thereof are not without inherent limitations.

Besides, Japanese Patent Kokai 56-123388 and 56-123389 disclose an electrode having a undercoating layer containing iridium oxide and tantalum oxide on an electroconductive metal substrate and an overcoating layer of lead dioxide. The undercoating layer in this electrode, however, serves to merely improve the adhesion between the substrate surface and the overcoating layer of lead dioxide to exhibit some effectiveness to prevent corrosion due to pin holes. When such an electrode is used in an oxygen generating electrolytic process, disadvantages are caused because of the insufficient effect of preventing formation of titanium oxide and unavoidable contamination of the electrolyte solution with lead.

SUMMARY OF THE INVENTION

An object of the present invention is therefore to provide a novel and improved electrode suitable for use in an oxygen-generating electrolytic process which is free from the above described problems and disadvantages in the prior art electrodes. More particularly, the object of the present invention is to provide an electrode formed of an electroconductive substrate of a metal such as titanium and provided with a coating layer basically composed of iridium oxide.

The electrode of the present invention suitable for use in an oxygen-generating electrolytic process is an integral body composed of:

(A) an electroconductive substrate made of a metal which is preferably titanium;

(B) an undercoating layer on the substrate surface formed of a binary mixture of iridium oxide and tantalum oxide each in a molar proportion in the range from 50% to 90% and from 50% to 10%, respectively, calculated as iridium metal and tantalum metal; and (C) an overcoating layer of iridium oxide in a coating amount in the range from 0.05 to 3 mg/cm, calculated as iridium metal.

BRIEF DESCRIPTION OF THE DRAWING

The figure is a graph showing the change of the cell voltage as a function of time when electrolysis is conducted continuously by using the electrodes prepared according to the invention and for comparative purpose.

DETAILED DESCRIPTION OF THE PREFERRED EMBODIMENTS

As is described above, the electrode of the invention has a basic structure that an electroconductive substrate of a metal such as titanium is provided with an undercoating layer formed of a binary oxide mixture composed of iridium oxide and tantalum oxide and an overcoating layer of iridium oxide. Such an undercoating layer of mixed oxide can be formed by coating the substrate surface with a coating solution containing an iridium compound and a tantalum compound each having decomposability by heating into respective oxides followed by a heat treatment in an oxidizing atmosphere to convert the thermally decomposable compounds into respective metal oxides.

Examples of the metal from which the electroconductive substrate is formed include so-called valve metals such as titanium, tantalum, zirconium and niobium as well as alloys of these metals, of which titanium is preferred in the invention. The substrate shaped from these metals or alloys in an appropriate form of electrode is first provided as mentioned above with an undercoating layer of the binary oxide mixture. Examples of suitable thermally decomposable compounds of iridium and tantalum include chloroiridic acid $H_2IrCl_6.6H_2O$ and tantalum halides and tantalum alkoxides, e.g., tantalum pentaethoxide $Ta(OC_2H_5)_5$, tantalum pentapropoxide $Ta(OC_3H_7)_5$ and tantalum pentabutoxide $Ta(OC_4H_9)_5$, respectively, convertible into the respective oxides. The coating solution can be prepared by dissolving these compounds in a suitable organic solvent such as butyl alcohol in a proportion to give a mixed-oxide coating layer in which the molar proportions of iridium and tantalum calculated as metals are in the ranges from 50% to 90% for iridium and from 50% to 10% for tantalum or preferably, from 50% to 70% for iridium and from 50% to 30% for tantalum. When the proportion of the tantalum oxide is too large, the undercoating layer would be less effective to provide protection of the substrate surface and adhesion between the substrate surface and the undercoating layer may be somewhat decreased in addition to the disadvantage of a decreased electroconductivity of the coating layer per se. The substrate coated with the coating solution is dried and subjected to a heat treatment at a temperature in the range from 400° to 550 ° C. in an oxidizing atmosphere containing oxygen such as air for a length of time of 1 to 30 minutes. When the atmosphere for the heat treatment is not fully oxidizing, the metal compounds can be oxidized into the respective oxides only incompletely to leave an amount of metallic constituents badly influencing the durability of the electrode. The thickness or coating amount of the undercoating layer is not particularly limitative but it should be at least 0.2 $mg/cm^2$ calculated as the iridium metal. When the coating amount is too small, no sufficient protection of the substrate surface can be obtained. If necessary, the cycle of coating with the coating solution and heat treatment to effect thermal oxidative decomposition of the metal compounds is repeated several times until the coating amount of the oxide mixture has reached the above mentioned preferable range.

When the undercoating layer composed of the binary oxide mixture of iridium oxide and tantalum oxide is formed in the above described manner, the undercoating layer is further coated with an overcoating layer of iridium oxide. Such a coating layer of iridium oxide can be formed by coating the surface with a coating solution prepared by dissolving a thermally decomposable iridium compound in an organic solvent followed by a heat treatment in an oxidizing atmosphere. The coating amount of the overcoating layer should be in the range from 0.05 to 3 $mg/cm^2$ calculated as iridium metal. When the coating amount of the overcoating layer is too small, a disadvantage is caused that the consumption of the electrode in the electrolytic process is increased to affect the durability of the electrode. When the coating amount of the overcoating layer is too large, on the other hand, the adhesive strength of the active electrode film is decreased along with eventual increase in the anode potential within a short time in the course of the electrolyte process thus adversely affecting the performance of the electrode decreased along with eventual increase in the anode potential within a short time in the course of the electrolytic process.

The procedure for providing the overcoating layer of iridium oxide is similar to the process for forming the binary mixed-oxide undercoating layer of iridium and tantalum oxides. Thus, a thermally decomposable iridium compound such as chloroiridic acid is dissolved in an organic solvent and the substrate provided with the undercoating layer of iridium and tantalum oxides is coated with the solution, dried and subjected to a heat treatment at a temperature in the range from 400° to 550 ° C. in an oxidizing atmosphere. It is of course that the cycle of coating with the solution of the iridium compound and heat treatment can be repeated several times until the coating amount has reached the desirable range mentioned above.

In the following, the electrode suitable for use in an oxygen-generating electrolytic process according to the invention is described in more detail by way of examples and comparative examples which should not be construed to limit the scope of the present invention in any way.

EXAMPLE 1

A first coating solution was prepared by dissolving chloroiridic acid $H_2IrCl_6.6H_2O$ and tantalum pentabutoxide $Ta(OC_4H_9)_5$ in n-butyl alcohol each in such an amount that the molar ratio of iridium to tantalum as metals was 60:40 and the total concentration thereof corresponded to 80 g of the metals per liter.

An electrode substrate made of titanium metal after an etching treatment using a hot aqueous solution of oxalic acid was coated by brushing with the coating solution prepared above and, after drying, subjected to a heat treatment at 450 ° C. in an electric oven into which air was blown. The coating layer of mixed oxide thus formed on the substrate surface had a thickness corresponding to a coating amount of about 0.1 mg/cm$^2$ calculated as metals. This procedure of coating with the coating solution, drying and a heat treatment in air was repeated 2 to 10 times to prepare five undercoated electrode bodies having different coating amounts of the mixed oxides of iridium and tantalum.

A second coating solution was prepared by dissolving chloroiridic acid in n-butyl alcohol in such an amount that the concentration of the compound as iridium metal was 60 g/liter. Each of the electrode bodies having an undercoating layer of a mixture of iridium and tantalum oxides formed by twice to 8 times repetition of the procedure of coating with the first coating solution, drying and a heat treatment as well as a fresh titanium made electrode substrate was coated with the second coating solution by brushing and, after drying, subjected to a heat treatment at 450 ° C. in an electric oven into which air was blown. This procedure of coating with the second coating solution, drying and a heat treatment was repeated several times in such a number of repetition that the total number of the repeated procedures of coating with either the first or the second coating solution, drying and heat treatment was always 10. In this manner, six coated electrodes No. 1 to No. 6 were prepared, of which No. 1 was prepared without undercoating with the first coating solution but 10 times repeated coating with the second coating solution and No. 6 was prepared with 10 times repeated coating with the first coating solution but without coating with the second coating solution, No. 2, No. 3, No. 4 and No. 5 being prepared with 2, 4, 6 and 8 times repeated coating with the first coating solution, respectively, and with 8, 6, 4 and 2 times repeated coating with the second coating solution, respectively.

Each of the thus prepared coated electrodes No. 1 to No. 6 was used as the anode for electrolysis of a 1 mole/liter aqueous solution of sulfuric acid at 60 ° C. with a platinum electrode as the cathode at a current density of 150 A/dm$^2$ continuously over a length of time up to 3000 hours under monitoring of the cell voltage. The figure of the accompanying drawing is a graph showing the change in the cell voltage for each electrode in the lapse of time. As is clear from this figure, the single-coated electrodes, i.e. No. 1 and No. 6, failed to serve for continued electrolysis already after about 1500 hours due to the increase of the cell voltage, which was initially about 5 volts, to exceed 10 volts. In contrast thereto, the dually coated electrodes, i.e. No. 2 to No. 5, could serve to continue the electrolysis even after about 3000 hours with little increase in the cell voltage.

The electrodes No. 1 to No. 5 were subjected to the measurement of the oxygen overvoltage by the potential scanning method in a 1 mole/liter aqueous solution of sulfuric acid at 30 ° C. with a current density of 20 A/dm$^2$. The results were: 440 mV, 430 mV, 430 mV, 410 mV and 380 mV for the electrodes No. 1 to No. 5, respectively.

EXAMPLE 2

Four coating solutions for undercoating were prepared each by dissolving chloroiridic acid $H_2IrCl_6.6H_2O$ and tantalum pentabutoxide $Ta(OC_4H_9)_5$ in n-butyl alcohol each in such an amount that the total concentration thereof corresponded to 80 g of the metals per liter but with varied molar proportions of iridium to tantalum as metals of 20:80, 50:50, 60:40 and 70:30.

Five titanium made electrode substrates were coated each with the second coating solution of tantalum pentabutoxide alone prepared in Example 1 (electrode No. 7) or one of the above prepared coating solutions of iridium:tantalum molar ratio of 20:80 (electrode No. 8), 50:50 (electrode No. 9), 60:40 (electrode No. 10) and 70:30 (electrode No. 11) followed by drying and a heat treatment at 500° C. in an electric oven into which air was blown. This procedure of coating with the coating solution, drying and heat treatment was repeated five times.

Each of the electrode bodies No. 7 to No. 11 was further coated with the second coating solution prepared in Example 1 followed by drying and a heat treatment at 500° C. in an electric oven into which air was blown. This procedure of coating with the second coating solution, drying and a heat treatment was repeated five times.

Each of the thus prepared coated electrodes No. 7 to No. 11 was used as the anode for electrolysis of a 1 mole/liter aqueous solution of sulfuric acid at 60 ° C. with a platinum electrode as the cathode at a current density of 200 A/dm$^2$ continuously over a length of time up to 1000 hours under monitoring of the cell voltage. The results were that the electrodes No. 9, No. 10 and No. 11 could serve to continue the electrolysis over 1000 hours while the electrolysis could no longer be continued after 200 hours and 400 hours of continued electrolysis with the electrodes No. 7 and No. 8, respectively.

What is claimed is:

1. An electrode for use in an oxygen-generating electrolytic process which is an integral body comprising:

(A) an electroconductive substrate made of a metal;

(B) an undercoating layer formed on the surface of the substrate and consisting of a mixture of an iridium oxide and a tantalum oxide in such a molar proportion that the content of the iridium oxide is in the range from 50% to 70% and the content of the tantalum oxide is in the range from 50% to 30% calculated as iridium metal and tantalum metal, respectively; and (C) an overcoating layer formed on the undercoating layer and consisting essentially of iridium oxide in such a coating amount in the range from 0.05 to 3 mg/cm$^2$ calculated as iridium metal and wherein the coating amount of the undercoating layer is at least 0.2 mg/cm$^2$ calculated as iridium metal.

2. The electrode as claimed in claim 1 wherein the metal forming the electroconductive substrate is titanium.

* * * * *